US011173335B2

(12) United States Patent
Horne

(10) Patent No.: US 11,173,335 B2
(45) Date of Patent: Nov. 16, 2021

(54) SUPPORT WITH HEIGHT AND WIDTH ADJUSTABILITY

(71) Applicant: HEALTHTEC DESIGN PTY. LTD., Tennyson (AU)

(72) Inventor: Desmond John Horne, Tennyson (AU)

(73) Assignee: HEALTHTEC DESIGN PTY. LTD., Tennyson (AU)

( * ) Notice: Subject to any disclaimer, the term of this patent is extended or adjusted under 35 U.S.C. 154(b) by 0 days.

(21) Appl. No.: 16/468,896

(22) PCT Filed: Dec. 12, 2017

(86) PCT No.: PCT/AU2017/051373

§ 371 (c)(1),
(2) Date: Jun. 12, 2019

(87) PCT Pub. No.: WO2018/107218

PCT Pub. Date: Jun. 21, 2018

(65) Prior Publication Data

US 2019/0314663 A1 Oct. 17, 2019

(30) Foreign Application Priority Data

Dec. 12, 2016 (AU) ..... 2016905128

(51) Int. Cl.
*A63B 3/00* (2006.01)
*A63B 22/00* (2006.01)

(52) U.S. Cl.
CPC ..... *A63B 3/00* (2013.01); *A63B 22/00* (2013.01); *A63B 2022/0094* (2013.01); *A63B 2225/093* (2013.01)

(58) Field of Classification Search
CPC ..... A61B 3/00; A61B 21/15; A61B 21/159; A61B 21/4047; A61B 21/4049;
(Continued)

(56) References Cited

U.S. PATENT DOCUMENTS 1,111,268 A * 9/1914 Medart ..... A63B 3/00 482/42
1,734,664 A * 11/1929 Albach ..... A63B 3/00 482/42
(Continued)

FOREIGN PATENT DOCUMENTS

AU 1896183 A 3/1984
CN 202070062 U 12/2011
(Continued)

OTHER PUBLICATIONS

International Search Report and Written Opinion dated Feb. 26, 2018 in related/corresponding International Application No. PCT/AU2017/051373.

*Primary Examiner* — Gary D Urbiel Goldner
(74) *Attorney, Agent, or Firm* — Patent Portfolio Builders PLLC

(57) ABSTRACT

A support and a support system enable assisting rehabilitation patients with walking and standing. The support includes a supporting structure with a longitudinal axis, the supporting structure having an upper structure and a lower structure; a height adjusting actuator configured to adjust a vertical distance between the upper structure and the lower structure; and a width adjusting actuator connected to the support structure, wherein the width adjusting actuator is configured to move at least part of the supporting structure in a transverse direction to the longitudinal axis.

15 Claims, 2 Drawing Sheets

(58) Field of Classification Search
CPC ..... A61B 22/0046; A61B 2022/0092; A61B 2022/0094; A61B 26/00; A61B 26/003; A61B 71/0009; A61B 2225/09; A61B 2225/093
See application file for complete search history.

(56) References Cited

U.S. PATENT DOCUMENTS 2,690,789 A * 10/1954 Zadrozny ..... A63B 3/00 482/42
2,788,971 A * 4/1957 Berne ..... A63B 3/00 482/42
2,808,873 A * 10/1957 Snapp, Jr. ..... A63B 3/00 482/42
3,184,232 A * 5/1965 Nissen ..... A63B 3/00 482/42
3,534,955 A * 10/1970 Wieland ..... A63B 3/00 482/42
3,697,066 A * 10/1972 Wieland ..... A63B 3/00 482/42
4,674,744 A 6/1987 Walsh
4,856,761 A * 8/1989 Berner ..... E04F 11/1863 256/59
4,939,876 A * 7/1990 Berner ..... E04F 11/1863 182/113
5,727,655 A * 3/1998 Pitman ..... B66F 7/0641 108/145
6,129,651 A * 10/2000 Denaro ..... A63B 21/00047 482/141
6,168,548 B1 * 1/2001 Fleming ..... A63B 3/00 482/23
6,336,892 B1 * 1/2002 Squibb ..... A63B 3/00 482/23
6,430,761 B1 8/2002 Brandorff et al.
7,637,851 B1 * 12/2009 Lormil ..... A63B 23/12 482/141
9,198,399 B1 * 12/2015 Grooms ..... A01K 15/025
9,227,822 B2 * 1/2016 Horne ..... A61G 15/02
2008/0207405 A1 8/2008 Jung
2010/0325797 A1 * 12/2010 Horne ..... B66F 7/0691 5/611
2011/0232665 A1 9/2011 Barnett, Jr.
2014/0087920 A1 3/2014 Nickel et al.

FOREIGN PATENT DOCUMENTS

CN 203264191 U 11/2013
CN 203915878 U 11/2014
CN 104225859 A 12/2014
CN 104722006 A 6/2015
EP 1704899 A1 9/2006
KR 100912607 B1 8/2009

* cited by examiner

SUPPORT WITH HEIGHT AND WIDTH ADJUSTABILITY

FIELD OF THE INVENTION

The invention relates to a support. In particular, the invention relates, but is not limited, to a support for assisting rehabilitation patients with walking and standing.

BACKGROUND TO THE INVENTION

Reference to background art herein is not to be construed as an admission that such art constitutes common general knowledge in Australia or elsewhere.

The medical industry is consistently striving to fulfil patient requirements. By way of example, parallel bars that assist patients with walking may include lifting columns to adjust the height of the parallel bars. This allows patients of different heights to suitably use the parallel bars during, for instance, rehabilitation. However, such lifting columns are heavy and cumbersome. Furthermore, readily adjusting lifting bars to account for the width requirements of different patients has also not been forthcoming.

Integrating systems of parallel bars for ease of use and transportation has also been an area where further attention is required. In this regard, the cost of such systems also needs to be considered to ensure that the end customer is receiving value for money whilst maintaining the safety and comfort for patients. Moreover, it will be appreciated that such systems should also attempt to accommodate for patients with particular needs including those who require, for example, a wheel chair. To this end, there are a variety of non-obvious compromises that need to be considered when developing equipment in the medical industry.

OBJECT OF THE INVENTION

It is an aim of this invention to provide a support which overcomes or ameliorates one or more of the disadvantages or problems described above, or which at least provides a useful alternative.

Other preferred objects of the present invention will become apparent from the following description.

SUMMARY OF INVENTION

In one form, although not necessarily the only or broadest form, the invention resides in a support including:

a supporting structure with a longitudinal axis, the supporting structure having an upper structure and a lower structure;

a height adjusting actuator configured to adjust a vertical distance between the upper structure and the lower structure; and a width adjusting actuator connected to the support structure, wherein the width adjusting actuator is configured to move at least part of the supporting structure in a transverse direction to the longitudinal axis.

Preferably, the width adjusting actuator is configured to rotate the supporting structure in order to move the at least part of the supporting structure in the transverse direction to the longitudinal axis.

Preferably, the width adjusting actuator is connected to the lower structure in a manner to rotate the lower structure about the longitudinal axis.

Preferably, in response to the width adjusting actuator moving in a substantially downward direction, the supporting structure is rotated in a first direction.

Preferably, in response to the width adjusting actuator moving in a substantially upward direction, the supporting structure is rotated in a second direction.

Preferably, the lower structure includes one or more rotational devices at each end. Preferably, the one or more rotational devices include a bearing.

Preferably, the width adjusting actuator is pivotally connected to the supporting structure.

Preferably, the lower structure includes an elongate base member that is connected to an extension member. Preferably, the width adjusting actuator is pivotally connected to the extension member.

Preferably, the width adjusting actuator extends in a substantially vertical direction.

Preferably, the width adjusting actuator is supported by a vertical mount. Preferably, the vertical mount includes a base that assists in supporting the lower structure.

Preferably, the height adjusting actuator and/or the width adjusting actuator are digitally controlled.

Preferably, a user interface assists in controlling the height adjusting actuator and/or the width adjusting actuator. Preferably, the user interface is in the form of a visual display.

Preferably, the supporting structure includes a middle structure that is pivotally connected to the upper structure and the lower structure.

Preferably, the height adjusting actuator is connected between the lower structure and the middle structure.

Preferably, the middle structure includes at least two bars that are pivotally connected to the upper structure and the lower structure.

Preferably, the height adjusting actuator is connected between one of the at least two bars and the lower structure.

Preferably, in response to the height adjusting actuator reducing the vertical distance between the upper structure and the lower structure, the at least two bars form a parallelogram with the upper structure and the lower structure.

Preferably, the upper structure includes a handrail.

Preferably, the support includes a floor. Preferably, the floor is connected to the vertical mount and/or the lower structure.

Preferably, the floor includes a plurality of floor sections.

Preferably, the floor sections are releasably connected together. Preferably, the floor sections are releasably connected together with a tongue and groove connection.

Preferably, the floor sections are aluminum, wood and/or plastic.

Preferably, the floor includes a ramp.

In another form the invention resides in a support including:

a supporting structure with a longitudinal axis, the supporting structure having a handrail connected to a lower structure; and a width adjusting actuator connected to the lower structure, wherein the width adjusting actuator is configured to rotate the lower structure in order to move the handrail about the longitudinal axis.

Preferably, the support is herein as described.

In another form the invention resides in a support including:

a supporting structure with a longitudinal axis, the supporting structure having a handrail connected to a lower structure; and a height adjusting actuator configured to adjust a vertical distance between the handrail and the lower structure, wherein the lower structure is configured to rotate about the longitudinal axis in order to move the handrail transversely to the longitudinal axis.

Preferably, an actuator assists in stopping the rotation of the lower structure at a predetermined location.

Preferably, the support is herein as described.

In another form the invention resides in a support system including:

a plurality of supports comprising:

a supporting structure having an upper structure and a lower structure;

a height adjusting actuator configured to adjust a vertical distance between the upper structure and the lower structure; and a width adjusting actuator connected to the support structure, wherein the plurality of supports include a first support that is arranged in a substantially parallel manner with a second support and the width adjusting actuator of the first support is configured to move the first support towards or away from the second support.

Preferably, the supports are herein as described.

Preferably, the width adjusting actuator of the first support is configured to move the first support towards or away from the second support by rotating the first support.

Preferably, the width adjusting actuator of the second support is configured to move the second support towards or away from the first support.

Preferably, the width adjusting actuator of the second support is configured to move the second support towards or away from the first support by rotating the second support.

Preferably, the support system includes a floor.

Preferably, the floor connects the first support to the second support.

Preferably, the floor is herein as described.

In another form the invention resides in a method for supporting a patient, the method including the steps of:

adjusting a width between two supports by rotating at least one of the supports;

having a patient hold a handrail of an upper structure of the two supports; and adjusting a vertical distance between the upper structure and a lower structure of the two supports in order to assist with lifting the patient.

Preferably, the step of adjusting the width between the two supports by rotating at least one of the supports includes using an actuator.

Preferably, the step of adjusting the width between the two supports by rotating at least one of the supports with the actuator includes parts of the actuator shifting in a substantially vertical direction.

Preferably, the step of adjusting the vertical distance between the upper structure and the lower structure of the two supports includes rotating the upper structure relative to the lower structure.

Preferably, the step of rotating the upper structure relative to the lower structure includes pivoting at least two bars between the upper structure and the lower structure.

Further features and advantages of the present invention will become apparent from the following detailed description.

BRIEF DESCRIPTION OF THE DRAWINGS

By way of example only, preferred embodiments of the invention will be described more fully hereinafter with reference to the accompanying figures, wherein.

DETAILED DESCRIPTION OF THE DRAWINGS

Figure 1:
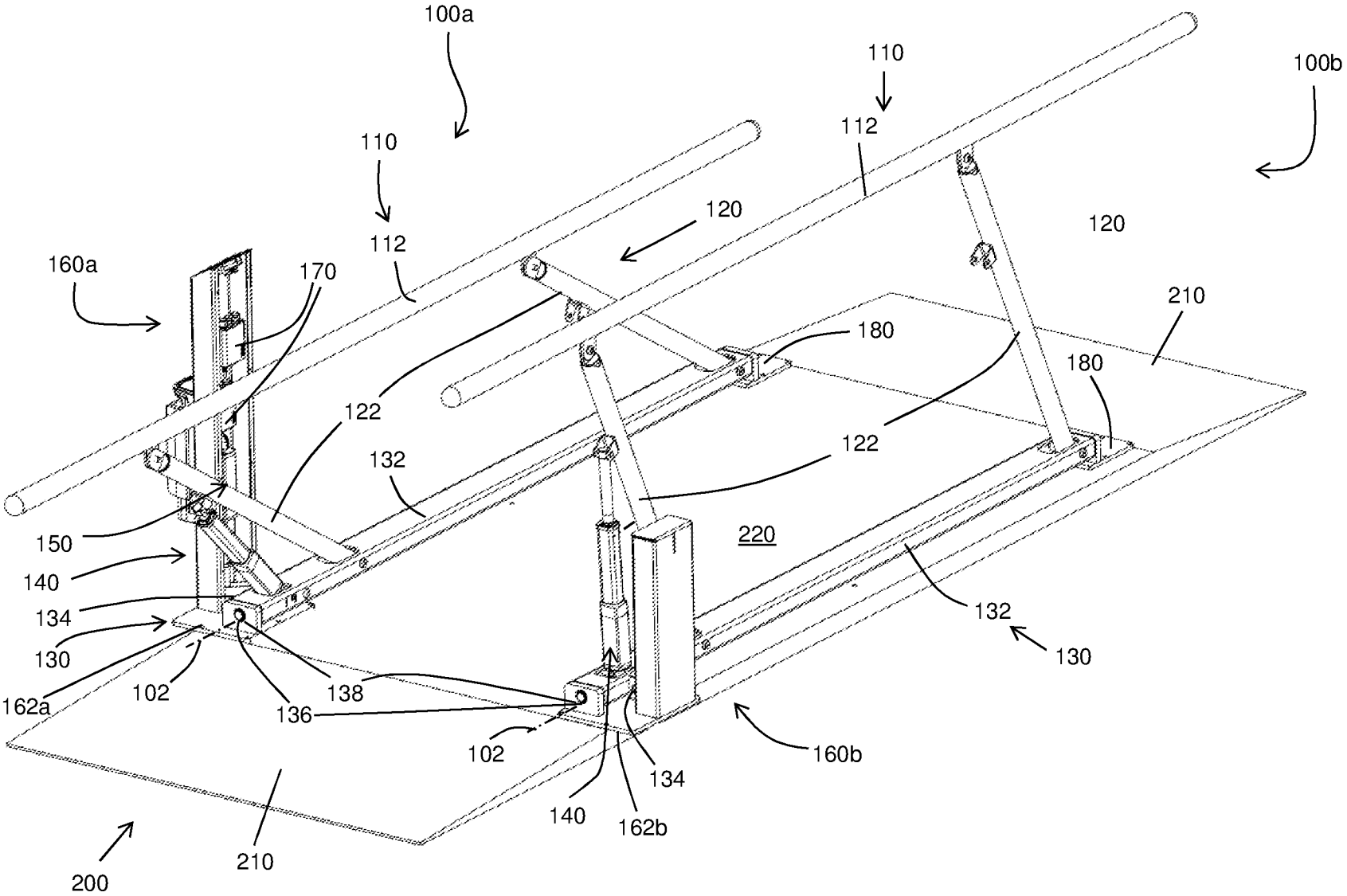
FIG. 1 illustrates a perspective view of a support system, according to an embodiment of the invention.

FIG. 1 illustrates a perspective view of a support system 10, according to an embodiment of the invention. The support system 10 includes a first support 100*a* and a second support 100*b*. In this regard, the use of a reference numeral followed by a lower case letter in this specification typically indicates alternative embodiments of a general element identified by the reference numeral. Thus for example the first support 100*a* is similar to but not identical to the second support 100*b*. Further, references to an element identified only by the numeral refer to all embodiments of that element. Thus for example a reference to the supports 100 is intended to include both the first support 100*a* and the second support 100*b*.

The supports 100 extend substantially parallel to each other in a longitudinal direction. The supports 100 include a supporting structure having an upper structure 110, a middle structure 120 and a lower structure 130. The upper structure 110 includes a handrail 112. The middle structure 120 is pivotally connected to the upper structure 110. In particular, the middle structure 120 includes two bars 122 that are pivotally connected to the handrail 112. The middle structure 120 is also pivotally connected to the lower structure 130, via the two bars 122. This allows the vertical distance between the upper structure 110 and the lower structure 130 to be varied, as outlined further below.

The lower structure 130 includes an elongate base member 132. The elongate base member 132 is rectangular in shape and hollow in this embodiment. The two bars 122 extend into the hollow of the elongate base member 132 and are pivotally connected thereto. The elongate base member 132 includes a shaft 136 at each end. The shafts 136 form part of a rotational device when they are connected to bearings 138. The elongate base member 132 is configured to rotate about longitudinal axis 102. In this regard, as the base member 132 rotates about the longitudinal axis 102, at least the upper structure 110 moves in a transverse direction to the longitudinal axis 102.

The elongate base member 132 is also connected to an extension member 134. The extension member 134 includes two spaced apart plates which, as further outlined below, are configured to receive an actuator therebetween.

The supports 100 each include a height adjusting actuator 140. The height adjusting actuators 140 are digitally controlled. The height adjusting actuators 140, respectively, are pivotally connected between one of the two bars 122 and the elongate base member 132. In this regard, as part of the height adjusting actuator 140 moves (i.e. its actuation shaft), the angle of the bars 122 is adjusted. This in turn adjusts the vertical distance between the upper structure 110 (i.e. the handrail 112) and the lower structure 130 (i.e. the elongate base member 132). The adjustment of different heights can be seen between the supports 100*a*, 100*b* in FIG. 1 but, it will be appreciated that during normal use, the height of the supports 100 will substantially the same. That is, the height of the supports 100 is controlled in unison.

The supports 100 also each include a width adjusting actuator 150. The width adjusting actuators 150 are digitally controlled. The width adjusting actuators 150 are respectively included in the vertical mounts 160*a*, 160*b*. In FIG. 1, a front cover has been removed from the vertical mount 160*a* to show the width adjusting actuator 150 therein. The width adjusting actuators 150 extend in a substantially vertical direction. The width adjusting actuators 150 are pivotally connected to respective extension members 134. That is, the width adjusting actuators 150 are received between the spaced apart plates of the extension member 134 and are pivotally connected thereto.

The vertical mounts 160 respectively include a base 162*a*, 162*b* that assists in supporting one shaft 136 and bearing 138 via an upstanding portion. The supports 100 also include a mount 180 that assists in supporting the shaft 136 and bearing 138 at the opposite end to the base 162. The vertical mount 160*a* also includes one or more controllers 170 that assist in controlling the height adjusting actuators 140 and the width adjusting actuators 150. The vertical mount 160*a* also includes a user interface, at an upper portion thereof, which communicates with the one or more controllers 170. The user interface in this embodiment includes a digital screen.

The support system 10 also includes a floor 200 in this embodiment. The floor includes ramps 210 and a portion 220 having a plurality of floor sections. The floor sections are sized to assist with shipping the floor 200. That is, the tongue and groove connections between the floor sections extend laterally across the support system 10. The floor 200 also assists in safely routing cabling between the supports 100*a*, 100*b*. In this regard, the routing of cabling with the assistance of the floor 200 removes, for example, potential trip hazards.

Figure 2:
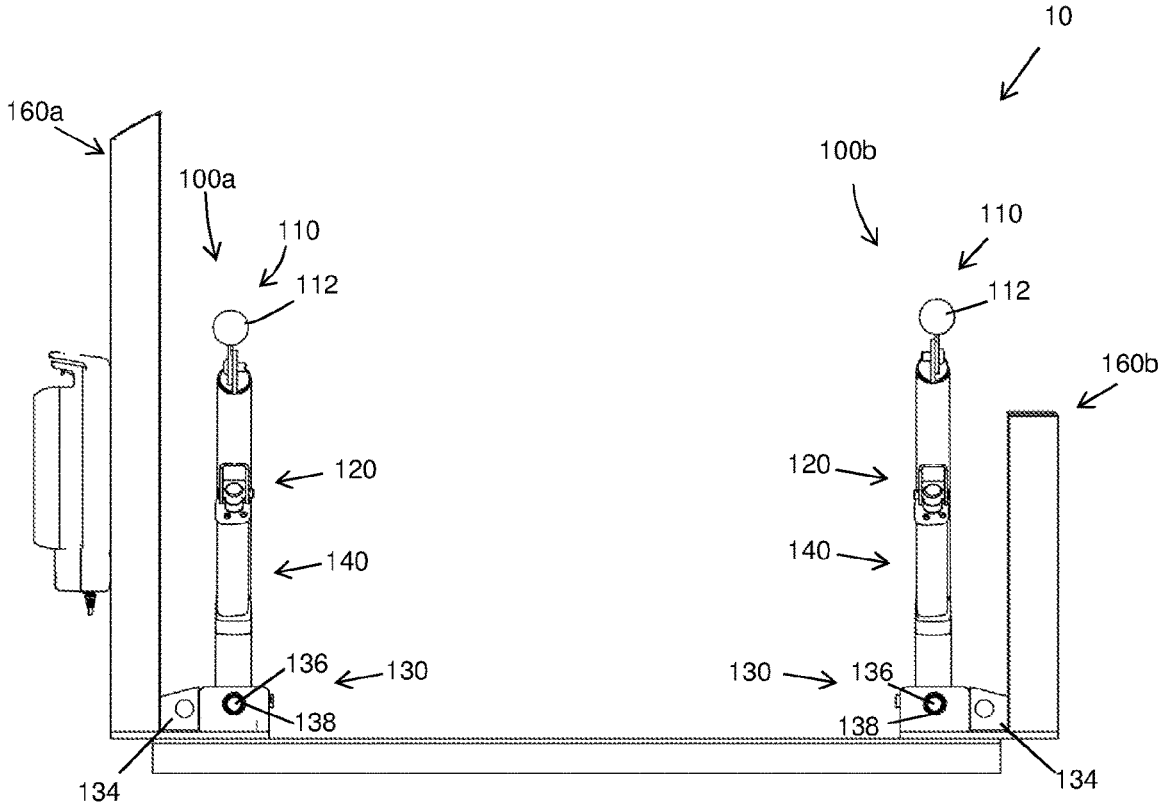
FIG. 2 illustrates a front view of the support system, as shown in FIG. 1, with the supports of the support system in a first configuration.
Figure 3:
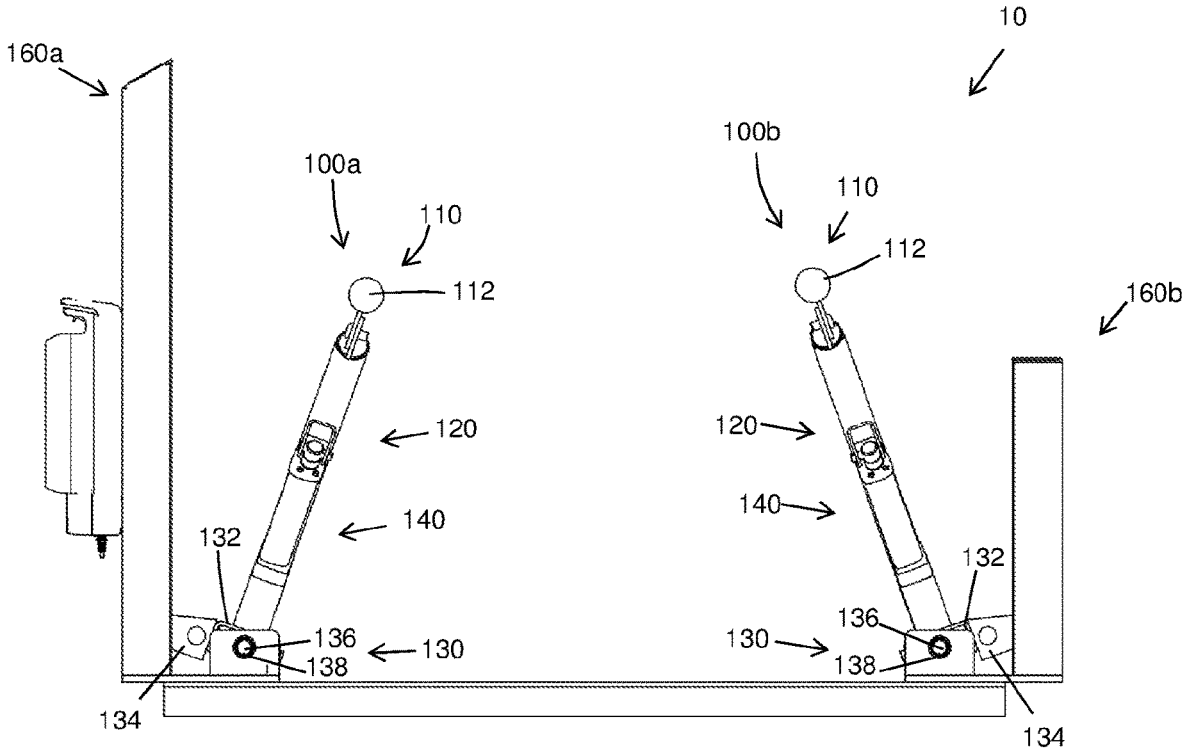
FIG. 3 illustrates a front view of the support system, as shown in FIG. 1, with the supports of the support system in a second configuration.

FIG. 2 shows the support system 10 in a first configuration where the supports 100 extend in a substantially vertical direction. In response to an operator requiring a change in width between the handrails 112, the operator will activate the width adjusting actuators 150 via the user interface. In the configuration shown in FIG. 3, an operator has caused at least part of the width adjusting actuators 150 to move upward. This in turn has rotated the supports 100 inwards towards the middle of the floor 200. That is, the connection between the width adjusting actuator 150 and the extension member 134 has caused the elongate base member 132 to rotate about its longitudinal axis 102 towards the middle of the floor 200. In this regard, the supports 100 have moved in a transverse direction to the longitudinal axis 102.

Furthermore, it is noted that movement associated with the width adjusting actuators 150 is synchronized such that handrails move symmetrically at an even rate. It will also be appreciated that if an operator requires the width between the handrails 112 to be increased, the direction of movement for the width adjusting actuators 150 may be reversed via the user interface.

As indicated above, an operator may also adjust the height of the handrails 112. In particular, through the user interface, the height adjusting actuators 140 may be activated to rotate the bars 122. The rotation of the bars 122 adjusts the height of the handrails 112 relative to, for example, the lower structure 130. Furthermore, the rotation of the bars 122 may also assist in, for example, allowing a patient to stand. That is, if a patient holds the hand rails 112 whilst the bars 122 are rotating in an upward direction, this will assist in pulling the patient up to a standing position.

Allowing easy adjustment of the width between the supports 100 provides further versatility in the present invention. By way of example, patients with different sized wheel chairs can be easily accommodated with simple adjustments via the user interface. Furthermore, by simply rotating the lower structures 130 to adjust width, the support system 10 provides a straightforward design and avoids unnecessary complexities.

The floor 200 further helps with integrating the components of the support system 10. Moreover, the floor 200 is able to be easily assembled/disassembled and shipped without undue effort.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

In this specification, the terms 'comprises', 'comprising', 'includes', 'including', or similar terms are intended to mean a non-exclusive inclusion, such that a method, system or apparatus that comprises a list of elements does not include those elements solely, but may well include other elements not listed.

The invention claimed is:

1. A rehabilitation support system, comprising:

a plurality of supports including a first support and a second support, each of the first and second supports comprising:

the supporting structure having an upper structure, a middle structure, and a lower structure, the longitudinal axis being horizontally disposed along a length of the lower structure a height adjusting actuator configured to adjust a vertical distance between the upper structure and the lower structure; and a width adjusting actuator connected to the supporting structure, wherein the first support is arranged in a substantially parallel manner with the second support, and the width adjusting actuator of the first support is configured to move the first support towards or away from the second support;

wherein adjusting the vertical distance between the upper structure and the lower structure of each of the first and second supports assists with lifting a patient;

wherein for each of the first and second supports, the vertical distance between the upper structure and the lower structure is adjusted by angular movement of the middle structure in a plane parallel to the longitudinal axis; and wherein a distance between the upper structures of the first and second supports is adjusted by movement of the middle structures of the first and second supports in a transverse direction to the longitudinal axes, respectively.

2. The rehabilitation support system of claim 1, wherein the width adjusting actuator of the first support is configured to move the first support towards or away from the second support by rotating the first support.

3. The rehabilitation support system of claim 1, wherein the width adjusting actuator of the second support is configured to move the second support towards or away from the first support.

4. The rehabilitation support system of claim 3, wherein the width adjusting actuator of the second support is configured to move the second support towards or away from the first support by rotating the second support.

5. The rehabilitation support system of claim 1, wherein the support system includes a floor.

6. The rehabilitation support system of claim 5, wherein the floor connects the first support to the second support.

7. The rehabilitation support system of claim 1, wherein, in response to the width adjusting actuator of the first support moving in a substantially downward direction, the supporting structure of the first support is rotated in a first direction.

8. The rehabilitation support system of claim 7, wherein, in response to the width adjusting actuator of the first support moving in a substantially upward direction, the supporting structure of the first support is rotated in a second direction.

9. The rehabilitation support system of claim 1, wherein the height adjusting actuator and/or the width adjusting actuator of the first support and/or the second support are digitally controlled.

10. The rehabilitation support system of claim 1, wherein a user interface assists in controlling the height adjusting actuator and/or the width adjusting actuator of the first support and/or the second support.

11. The rehabilitation support system of claim 1, wherein for each of the first and second supports, the supporting structure includes the middle structure that is pivotally connected to the upper structure and the lower structure.

12. The rehabilitation support system of claim 11, wherein for each of the first and second supports, the height adjusting actuator is connected between the lower structure and the middle structure.

13. The rehabilitation support system of claim 11, wherein for each of the first and second supports, the middle structure includes at least two bars that are pivotally connected to the upper structure and the lower structure.

14. The rehabilitation support system of claim 13, wherein for each of the first and second supports, the height adjusting actuator is connected between one of the at least two bars and the lower structure.

15. The rehabilitation support system of claim 13, wherein, for each of the first and second supports, in response to the height adjusting actuator reducing the vertical distance between the upper structure and the lower structure, the at least two bars form a parallelogram with the upper structure and the lower structure.

* * * * *